US005315969A

United States Patent [19]

MacMillan

[11] Patent Number: 5,315,969

[45] Date of Patent: May 31, 1994

[54] INTERNAL COMBUSTION ENGINE WITH ROTARY VALVES

[76] Inventor: Kevin M. MacMillan, 1173 Saint George Dr., San Dimas, Calif. 91773

[21] Appl. No.: 11,876

[22] Filed: Feb. 1, 1993

[51] Int. Cl.[5] ..... F01L 7/02

[52] U.S. Cl. ..... 123/190.6; 123/190.8

[58] Field of Search ..... 123/190.6, 190.1, 190.4, 123/190.8, 190.15

[56] References Cited

U.S. PATENT DOCUMENTS

| | | | |
|---|---|---|---|
| 2,048,134 | 7/1936 | Montalto | 123/190.8 |
| 2,158,386 | 5/1939 | Sykes | 123/190.8 |
| 2,211,288 | 8/1940 | Oesch | 123/190.8 |
| 3,871,340 | 3/1975 | Zimmerman | 123/190.8 |
| 3,896,781 | 7/1975 | Smith | 123/190.6 |
| 3,977,303 | 8/1976 | Baker | 123/190.8 |
| 4,782,801 | 11/1988 | Ficht et al. | 123/190.8 |
| 5,025,349 | 10/1991 | Buelna | 123/190.14 |
| 5,074,265 | 12/1991 | Ristin et al. | 123/190.8 |

*Primary Examiner*—Noah P. Kamen
*Assistant Examiner*—Erick Solis
*Attorney, Agent, or Firm*—Edgar W. Averill, Jr.

[57] ABSTRACT

An improved internal combustion engine with rotary valves. The engine includes a cylinder head above each cylinder and there is a single opening located in the cylinder head above each piston for use as an intake and as an exhaust port. A rotary valve member is in the form of a hollow cylinder, the outer surface of which abuts the outer surface of the single opening, the rotary valve has an intake port formed through the wall thereof and an exhaust port also formed through the sidewall, the cylinder includes an inner wall dividing the interior of the rotary valve cylinder into an exhaust compartment and an intake compartment. The rotary member has an opening at one end which comprises the intake port and an opening at an opposite end which comprises the exhaust port. Means are provided for rotating the rotary valve in a timed manner so that as the piston moves downwardly in an intake stroke, the intake port is passing over the single opening permitting an air fuel mixture to be drawn through the intake end the rotary valve and into the cylinder. As the piston begins to move upwardly in a compression stroke, the cylindrical sidewall of the rotary valve is passing over the single opening which is also the case as the piston is moving downwardly in a power stroke. Then as the piston begins moving up in an exhaust stroke, the exhaust port passes over the single opening causing the exhaust gases to flow out of the exhaust end of the rotary valve member.

8 Claims, 4 Drawing Sheets

INTERNAL COMBUSTION ENGINE WITH ROTARY VALVES

BACKGROUND OF THE INVENTION

The field of the invention is internal combustion engines and the invention relates more particularly to four cycle internal combustion engines of the type utilized in automobiles and other motor vehicles.

Rotary valves have been used in an internal combustion engines at least in the patent literature. The Tischler U.S. Pat. No. 3,993,036 shows an internal combustion engine with two rotary valves about each cylinder. The Lyons et al U.S. Pat. No. 4,473,041 similarly has a pair of rotary valves about each cylinder.

Lyons, et al U.S. Pat. No. 4,545,337 shows another construction of a dual rotary valve engine with two rotary valves above each cylinder.

Lastly, the Hansard U.S. Pat. No. 5,003,942 shows a rotary vaned valve has an intake valve and a second exhaust valve above each cylinder.

It is not believed that any of the rotary valve engines set forth above have become practical and yet the concept of having a valve opening which provides a much larger port for the intake of air fuel mixture and the expelling of exhaust gases can provide a more efficient engine, as compared to the conventional poppet valves. Conventional valves provide a substantial amount of resistance to gas flow as they are only opened around the annular edges thereof.

SUMMARY OF THE INVENTION

It is the object of the present invention to provide a rotating valve construction which provides a larger unrestricted opening for the intake of air fuel mixture and also for the exhaust of exhaust gases.

The present invention is for an improved internal combustion engine with rotary valves. The engine is of the type having an engine block supporting a crank shaft connected through connecting rods to a plurality of pistons in a plurality of cylinders. A cylinder head is affixed to the block and contains at least one spark plug or other igniting means. A single opening is located in the cylinder head above each piston for use as an intake and as an exhaust port. The single opening has an inner surface in the cylinder and an outer surface, and the outer surface is arcuate in shape. A rotary valve member is supported above the cylinder and has a cylindrical sidewall and a longitudinal axis. It has an inner surface and an outer surface, and the outer surface mates with the arcuate outer surface of the single opening. The rotary valve has an open intake end and an open exhaust end, an intake port formed through the sidewall and an exhaust port also formed through the sidewall. A partition is formed within the rotary valve cylindrical inner wall which divides the inner wall into an exhaust compartment and an intake compartment and the partition runs the entire length of the rotary valve. Means are provided for rotating the rotary valve in a timed manner with the crank shaft so that as the piston moves downwardly in an intake stroke, the intake port is passing over said single opening permitting an air fuel mixture to be drawn through the intake end of the rotary valve and into the cylinder. As the piston begins to move upwardly in a compression stroke, the cylindrical sidewall of the rotary valve covers the single opening and continues to cover the single opening during the power stroke. Next, the exhaust port passes over the single opening, and as the piston once again rises, the exhaust gases are forced through the exhaust port and through the exhaust end of the rotary valve member. Preferably, the rotary valve members are positioned side by side, and have a gear extending from the outer surface thereof, so that the turning of one valve causes the adjacent valve to turn. Preferably, the intake and exhaust ports are generally rectangular in shape.

DESCRIPTION OF THE PREFERRED EMBODIMENTS

Figure 1:
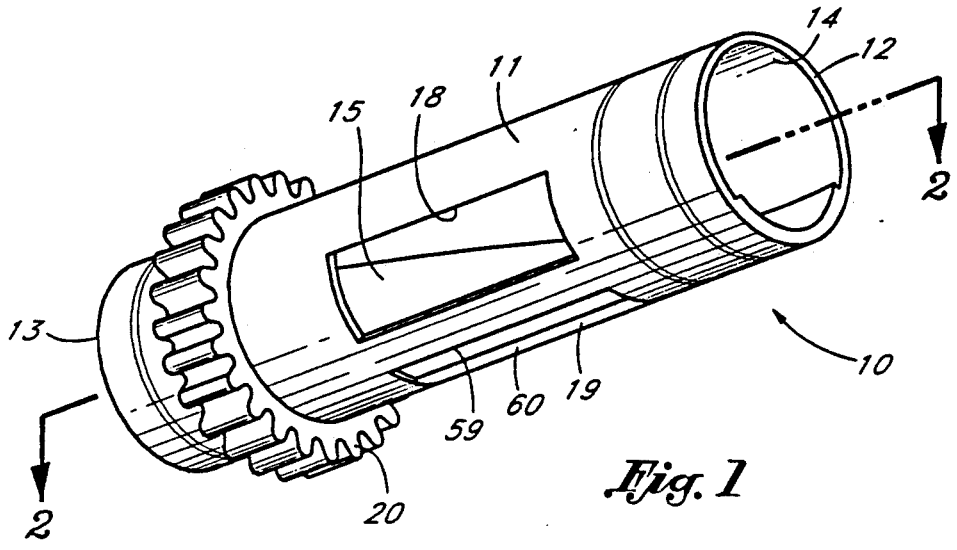
FIG. 1 is a perspective view of the rotary valve of the present invention.

The rotary valve of the present invention is shown in perspective view in FIG. 1 and indicated generally by reference character 10. Rotary valve 10 has a cylindrical sidewall 11, an exhaust end 12 and an intake end 13. The rotary valve member is basically a hollow cylinder having a cylindrical inner wall 14 and a partition 15 separates the cylindrical inner wall into an intake compartment 16 and an exhaust compartment 17 shown best in FIG. 2. An intake port 18 passes through the cylindrical sidewall 11 into the intake compartment 16. Similarly, an exhaust port 19 passes through the cylindrical sidewall 11 into the exhaust compartment 17. A gear 20 is formed about the cylindrical sidewall 11 which permits adjacent rotary valves to turn in opposite directions to one another as shown best in FIG. 3.

Figure 3:
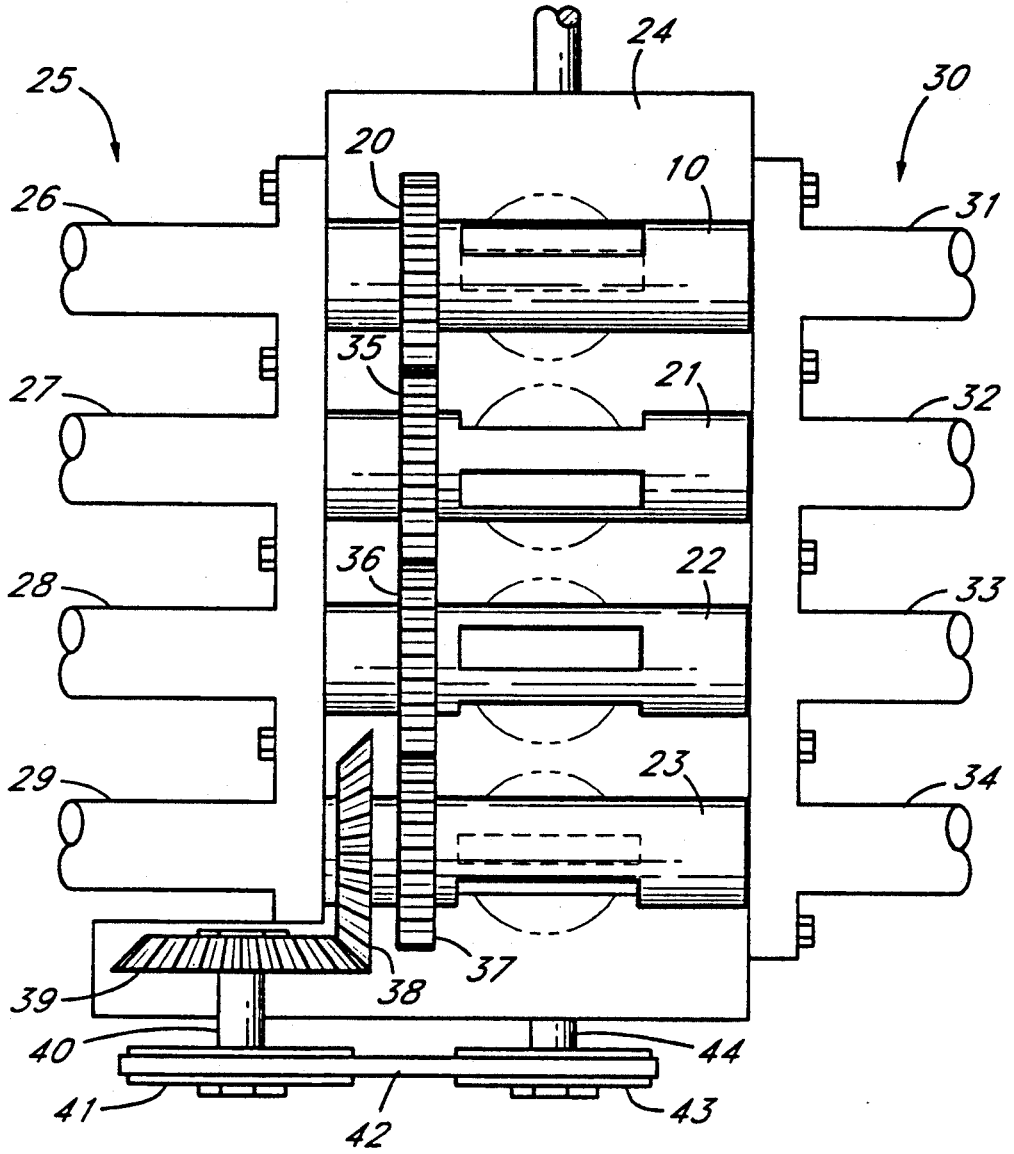
FIG. 3 is a plan view of a four-cylinder engine utilizing the four of the rotary valves of FIG. 1.

In FIG. 3 four rotary valves, 10, 21, 22, and 23 are positioned above an engine block 24. An intake manifold 25 has four intake ports 26, 27, 28, and 29, similarly an exhaust manifold 30 has four exhaust ports 31, 32, 33, and 34.

The rotary valve members 10, 21, and 23, are synchronized by gears 20, 35, 36, and 37 which are driven by a bevel gear 38 which is, in turn, driven by bevel gear 39 held by shaft 40. Shaft 40 is connected to a pulley 41, and turned by a drive belt 42 which, in turn, is driven by pulley 43 affixed to shaft 44 which is integral with the crank shaft of the engine.

Figure 4:
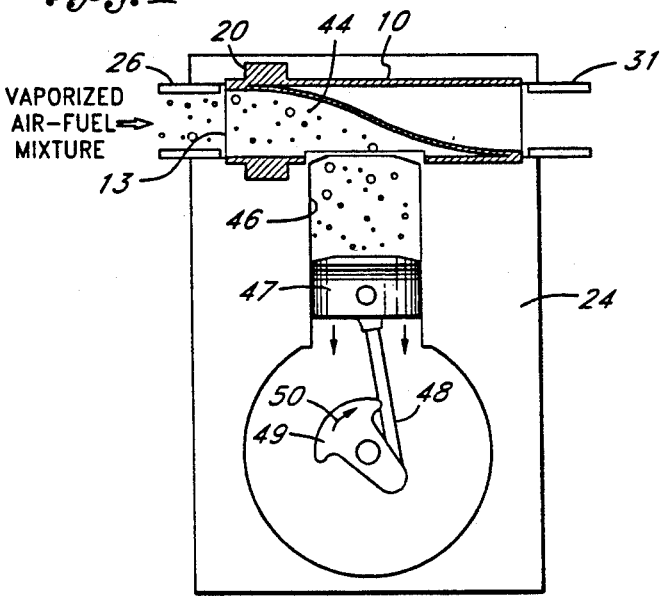
FIG. 4 is a diagrammatic view of the rotary of FIG. 1 positioned above a cylinder in an intake stroke.
Figure 5:
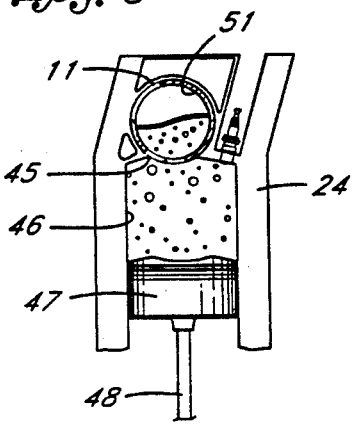
FIG. 5 is an end view of the assembly of FIG. 4.

A diagrammatic side view of the rotary valve 10 is shown in FIG. 4 where intake port 26 is connected to the intake end 13 of rotary valve 10, the vaporized fuel air mixture is indicated by reference character 44 and this passes through a rectangular opening 45 at the top of cylinder 46 and above piston 47. Piston 47 has a connecting rod 48 which is connected in a conventional manner to crank shaft 49 which rotates as indicated by arrow 50. Piston 47 is moving downwardly drawing air fuel mixture 44 into cylinder 46. The assembly of FIG. 4 is shown so that the rotary valve 10 is shown in end view in FIG. 5. There it can be seen that the cylindrical side wall 11 is supported by a solid semi-circular upper valve support 51. Also, the single opening 45 in the cylinder head is shown in end view where it can be seen by comparing FIGS. 4 and 5 that the rectangular opening is elongated so that the sides shown in FIG. 4 are longer than the sides shown in FIG. 5. The outer surface of the single opening 55 is arcuate in shape to meet with the shape of the exterior cylindrical side wall 11 of valve such as rotary valve 10.

Figure 6:
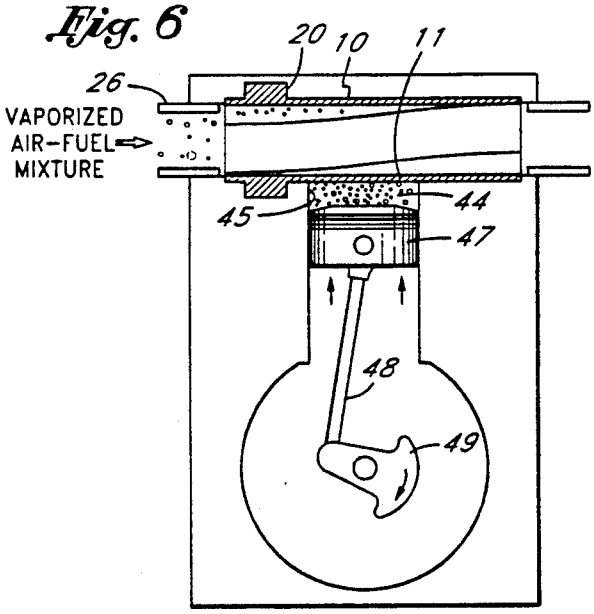
FIG. 6 is a side view of the rotary valve in a compression stroke.
Figure 7:
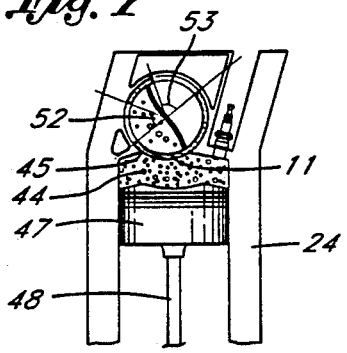
FIG. 7 is an end view of the rotary valve cylinder and piston of FIG. 6.

As the crank shaft 49 continues to turn, the piston 47 begins to move upwardly and the rotary valve, of course, continues to rotate so that its cylindrical side wall 11 blocks the rectangular opening 45 as shown in FIG. 6 closing the opening causing the air fuel mixture 44 to compress in a conventional manner. This view is shown in FIG. 7 so that the end view of rotary valve 10 is shown. Also in FIG. 7 two different angles have been indicated. This duration of the intake port is indicated by reference character 52 and the duration of the exhaust port is indicated by reference character 53. The duration of intake 52 is preferably between 50° and 320° and ideally about 280° whereas the duration of the exhaust port is preferably between 50° and 340° and preferably about 280°.

Figure 8:
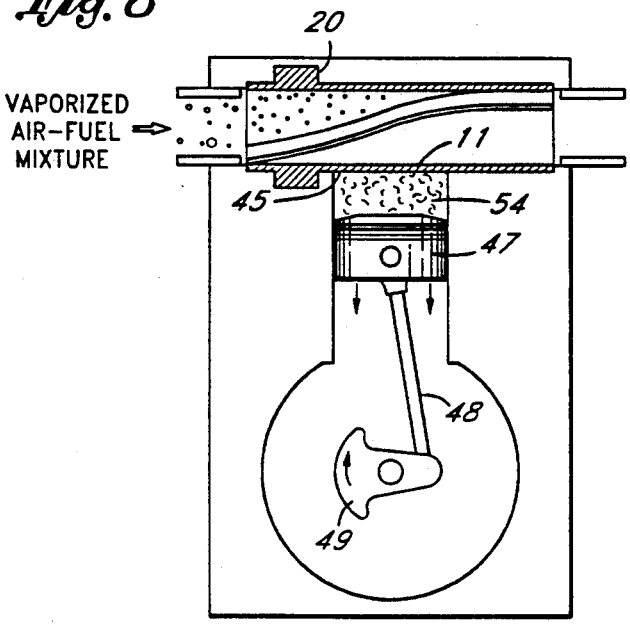
FIG. 8 is a side view of the rotary valve cylinder and piston of FIG. 4 in a power stroke.
Figure 9:
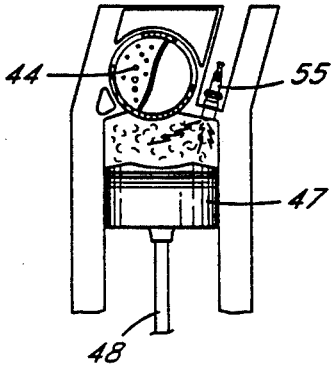
FIG. 9 is an end view of the assembly of FIG. 8.
Figure 10:
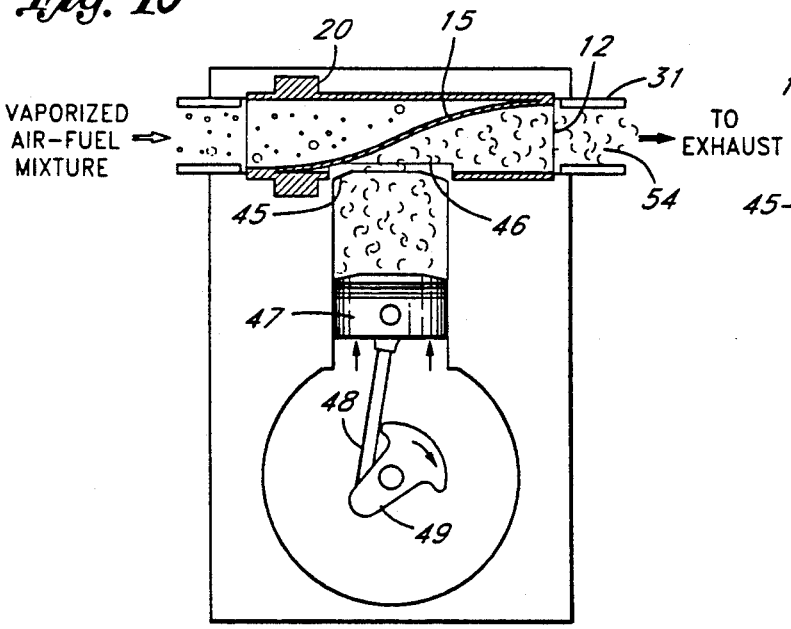
FIG. 10 is a side view of the rotary valve cylinder and piston of FIG. 4 in an exhaust stroke.

Turning now to FIG. 8, the air fuel mixture has been ignited forcing the piston 47 to move downwardly. The rectangular opening 45 is, of course, closed by the sidewall 11 of rotary valve 10. The exhaust gases are indicated by reference character 54. The spark plug is shown igniting in FIG. 9 and is indicated by reference character 55.

Figure 11:
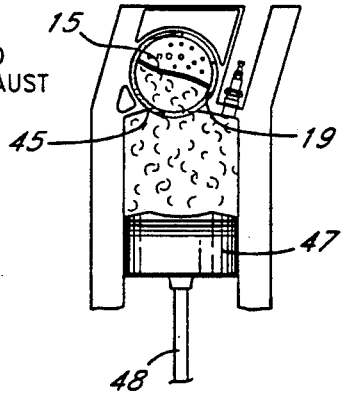
FIG. 11 is an end view of the apparatus of FIG. 10.

As the crank shaft 49 continues to turn, the piston 47 is moved upwardly and the single opening 45 above the cylinder 46 coincides with the exhaust port 19, directing exhaust gases 54 out of the exhaust end 12 and to exhaust port 31. This is shown so that the rotary valve 10 is an end view in FIG. 11. Of course, the central partition 15 divides the exhaust portion of rotary valve 10 from the intake portion.

Figure 2:
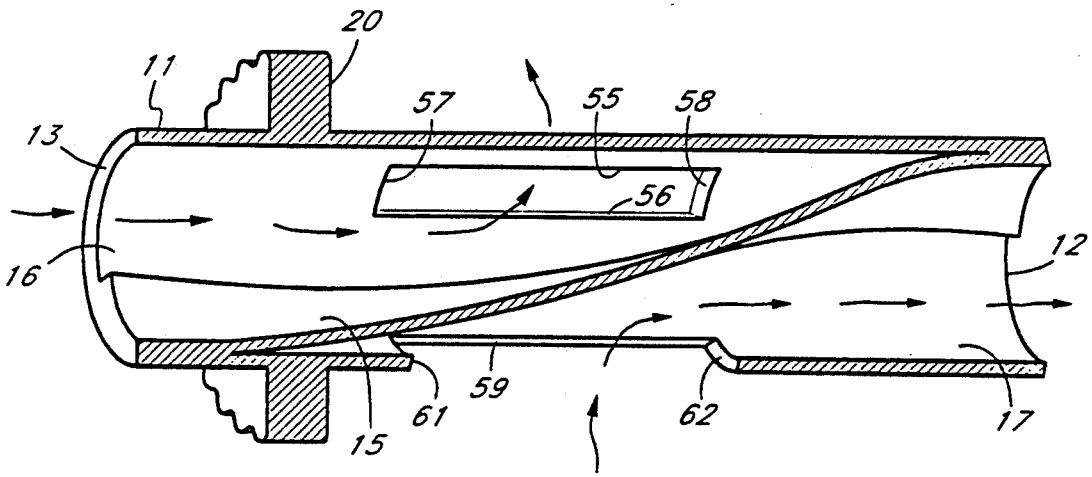
FIG. 2 is a cross-sectional view taken along line 2—2 of FIG. 1.

The result of the construction of the present invention is that a very large opening is provided for the passage of air fuel mixture as shown best in FIGS. 1 and 2, the intake port is preferably a rectangular opening having two longer sides 55 and 56 and two shorter sides 57 and 58.

Similarly, exhaust port 19 has two longer sides 59 and 60 and two shorter sides 61 and 62. While the openings are shown as rectangular, they could, of course, be elliptical or other curved shape, but the area of the opening should be about two to three times the area of a conventional poppet valve opening. This provides a substantially larger opening for enabling the engine to breathe far more efficiently than the conventional poppet valve construction.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved internal combustion engine with rotary valves of the type having an engine block supporting a crankshaft, connected through connecting rods to a plurality of pistons in a plurality of cylinders, a cylinder head containing at least one spark plug, wherein the improvement comprises:

a single opening located in said cylinder head about centrally positioned above each piston for use as an intake and an exhaust port, said single opening having an inner surface in each said cylinder and an outer surface, said outer surface being arcuate for contact with a rotary valve member;

a rotary valve member having a cylindrical side wall with a central axis and an inner surface and an outer surface, the outer surface of said cylindrical side wall mates with the arcuate outer surface of the single opening and a cylindrical inner wall surrounding an inner volume and having an open intake end and an open exhaust end, an intake port formed through the cylindrical side wall, an exhaust port formed through said sidewall spaced from said intake port, a partition positioned within said cylindrical inner wall dividing the inner volume into an exhaust compartment and an intake compartment and said intake port communicating with said intake compartment and said exhaust port communicating with said exhaust compartment and said intake compartment communication with the open intake end and the exhaust compartment communicating with the open exhaust end and said partition extending about the entire distance from the open intake end to the open exhaust end; and means for rotating said rotary valve in a timed manner with said crankshaft so that as the piston moves downwardly in an intake stroke the intake port is passing over said single opening permitting an air fuel mixture to be drawn through said intake end of said rotary valve and into a cylinder, when said piston moves upwardly in a compression stroke, the cylindrical side wall is passing over said single opening, when said piston moves downwardly in a power stroke, the cylindrical side wall is passing over said single opening and when said piston is moving upwardly, the exhaust port is passing over said single opening causing the exhaust gasses to flow out of the exhaust end of said rotary valve member.

2. The improved internal combustion engine of claim 1 wherein said means for rotating said rotary valve comprises a gear surrounding said cylindrical side wall near one of said ends thereof.

3. The improved internal combustion engine of claim 2 wherein said gear of one of said rotary valves meshes with the gear of an adjacent rotary valve.

4. The improved internal combustion engine of claim 3 wherein a set of rotary valves in a cylinder head are aligned with one another and the set of rotary valves is rotated by driving one of said gears of the rotary valve set whereby all rotary valves in a set rotate in opposite directions to that of the adjacent valve or valves.

5. The improved internal combustion engine of claim 1 wherein the partition is integral with the cylinder side wall.

6. The improved internal combustion engine of claim 1 wherein said cylinder head includes a semi-cylindrical upper valve support surface.

7. The improved internal combustion engine of claim 1 wherein said exhaust port is an elongated rectangular opening having two longer sides and two shorter sides with its longer sides parallel to the axis of the cylindrical side wall and said shorter sides subtending an exhaust port dwell angle about said cylindrical sidewall.

8. The improved internal combustion engine of claim 1 wherein said intake port is an elongated rectangular opening with two longer sides and two shorter sides and its longer sides being parallel to the axis of the cylindrical side wall and its shorter sides subtending an intake port dwell angle about said cylindrical sidewall.

* * * * *